United States Patent [19]

Antwi

[11] Patent Number: 4,953,871

[45] Date of Patent: Sep. 4, 1990

[54] TRAFFIC BOARD GAME

[76] Inventor: Samuel Antwi, 1 - 15 Litchfield Gardens, Winsted, Conn. 06098

[21] Appl. No.: 274,916

[22] Filed: Nov. 22, 1988

[51] Int. Cl.[5] ..... A63F 3/00; A63F 9/18

[52] U.S. Cl. ..... 273/252

[58] Field of Search ..... 273/251, 252, 254, 249, 273/248, 243; 283/63 R

[56] References Cited

U.S. PATENT DOCUMENTS

| | | | |
|---|---|---|---|
| 1,505,071 | 8/1924 | Fraser | 273/252 |
| 2,163,011 | 6/1939 | Schaub | 273/252 |
| 3,924,858 | 12/1975 | Dittrich et al. | 273/254 |
| 4,087,094 | 5/1978 | Bakay | 273/254 |
| 4,588,210 | 5/1986 | Tabatch et al. | 283/63 R |

FOREIGN PATENT DOCUMENTS

| | | | |
|---|---|---|---|
| 2085734 | 5/1982 | United Kingdom | 273/254 |

*Primary Examiner*—Benjamin Layno

*Attorney, Agent, or Firm*—Chilton, Alix & Van Kirk

[57] ABSTRACT

A board substrate supports a playing surface having differentiated markings. The markings include symbolic representations of the topography of a hypothetical community including buildings and a multiplicity of intersecting roadways. The roadways include markings which divide each roadway into a multiplicity of distinct, serially connected road segment intervals along which the gam pieces are moved. The markings further include a first class of indicia associated with some of the road segment intervals, defining a plurality of first traffic control parameters that influence the movement of the game pieces. A second class of indicia are marked on the playing surface and associated with some of the road segment intervals, for indicating the occurrence of an unusual event or traffic violation when occupied by a game piece. Upon landing on such second class of indicia, the player selects one of a multiplicity of event cards. The player who takes an event card is then asked a question pertaining to automotive safety or traffic laws. If the player answers incorrectly, points are lost in accordance with the particular event card selected.

13 Claims, 5 Drawing Sheets

66

TRAFFITEX POLICE REPORT

| 68 Violation # | 70 Question # | 72 Answer | 74 Points |
|---|---|---|---|
| 1. Failure to stop at a stop sign. | 1. What does any eight-sided red sign mean? | Stop | -50 -25 -0 |
| 2. Failure to turn in your license plate when you sold your vehicle. | 2. What does a black arrow pointing to the left, which is circled in red and has a red slash through it mean? | You may not turn left. | -35 -20 -0 |
| 3. Failure to grant right of way. | 3. At an intersection, drivers turning left must yield to what? | Cars continuing straight through the intersection or oncomers turning right and pedestrians. | -50 -25 -0 |
| 4. Failure to give way to pedestrians. | 4. At an intersection with a four-way stop, which driver can go first? | The driver that reached the intersection first. | -75 -35 -0 |
| 5. Your car is out of gas. | 5. What steps do you take when you are parked on a hill with the front of your car pointing downhill? | Set your parking brake. Shift into park or reverse. Make sure your wheels are turned into the curb. | -40 -20 -0 |
| 6. Failure to wear your prescribed driving glasses. | 6. How far ahead should you look when you are on the open highway? | About a quarter of a mile. | -70 -35 -0 |
| 7. Dirty windshield and broken viewing mirror. | 7. When you look down the road ahead, how much of the scene should your eyes take in? | Both sides of the road as well as the road. | -50 -25 -0 |
| 8. Failure to give proper turn signal. | 8. Why shouldn't you rely on another driver's turn signal light? | The lights may have been left on from an earlier turn or lane change. | -50 -25 -0 |

FIG. 6

Name _____

Traffitex Drivers License Report

| VIOLATION | PENALTY | FINAL POINTS | | |
|---|---|---|---|---|
| | | 2500 POINTS TO START | | |
| | | (Circle One) | | |
| 78 1 | -50 | -50 | -25 | -0 |
| 2 | -35 | -35 | -20 | -0 |
| 3 | -50 | -50 | -25 | -0 |
| 4 | -75 | -75 | -35 | -0 |
| 5 | -40 | -40 | -20 | -0 |
| 6 | -70 | -70 | -35 | -0 |
| 7 | -50 | -50 | -25 | -0 |
| 8 | -50 | -50 | -25 | -0 |
| 9 | -100 | -100 | -50 | -0 |
| 10 | -50 | -50 | -25 | -0 |
| 11 | -100 | -100 | -50 | -0 |
| 12 | -25 | -25 | -12 | -0 |
| 13 | -50 | -50 | -25 | -0 |
| 14 | -60 | -60 | -30 | -0 |
| 15 | -45 | -45 | -20 | -0 |
| 16 | -250 | -250 | -125 | -0 |
| 17 | -50 | -50 | -25 | -0 |
| 18 | -100 | -100 | -50 | -0 |
| 19 | -50 | -50 | -25 | -0 |
| 20 | -50 | -50 | -25 | -0 |
| 21 | -50 | -50 | -25 | -0 |
| 22 | -200 | -200 | -100 | -0 |
| 23 | -300 | -300 | -150 | -0 |
| 24 | -50 | -50 | -25 | -0 |
| 25 | -105 | -105 | -55 | -0 |
| 26 | -200 | -200 | -100 | -0 |
| 27 | -250 | -250 | -125 | -0 |
| 28 | -50 | -50 | -25 | -0 |
| 29 | -55 | -55 | -30 | -0 |
| 30 | -50 | -50 | -25 | -0 |
| 31 | -300 | -300 | -150 | -0 |
| 32 | -50 | -50 | -25 | -0 |
| 33 | -50 | -50 | -25 | -0 |
| 34 | -25 | -25 | -10 | -0 |
| 35 | -100 | -100 | -50 | -0 |
| 36 | -250 | -250 | -125 | -0 |
| 37 | -100 | -100 | -50 | -0 |
| 38 | -25 | -25 | -10 | -0 |
| 39 | -50 | -50 | -25 | -0 |
| 40 | -350 | -350 | -175 | -0 |
| 41 | -400 | -400 | -200 | -0 |
| 42 | -200 | -200 | -100 | -0 |
| 43 | -100 | -100 | -50 | -0 |
| 44 | -100 | -100 | -50 | -0 |

BONUS BOX
+

TOTAL

FIG. 8

TRAFFIC BOARD GAME

BACKGROUND OF THE INVENTION

The present invention relates to board games, and more particularly a type of board game in which playing pieces are moved in accordance with a chance device to simulate travel from an origin to a destination.

A variety of travel type board games are known, particularly for simulating travel by automobile. Examples include U.S. Pat. No. 4,375,889 (Burkett), which discloses a board game having a plurality of city streets on which game pieces are moved, with the object of obtaining the highest mileage while traveling through the city. Along their travel paths, the players may encounter a variety of features such as freeways, obstacles, and traffic violations.

U.S. Pat. No. 4,087,094 (Bakay) discloses a rectangular grid surrounded by a freeway, on which game pieces are moved in accordance with thrown dice. The particular movement during a game is influenced by various destination and trouble cards.

These and other patents disclose games in which travel conditions are simulated with some elements of chance, such as dice and drawn cards, sometimes combined with elements of strategy, in the selection by the player of one of a plurality of available paths to reach a given destination. In some of these games, the players may come to learn through markings on the game board or drawn cards, about certain unsafe driving habits or traffic laws, but this is purely incidental to the playing of the game.

SUMMARY OF THE INVENTION

It is an object of the present invention to combine a more strategically challenging form of travel game with a more complete and systematic educational component.

It is a further object of the invention to provide a game which is interesting and entertaining for adults, yet is suitable for use as curriculum material for young teenagers in a formal schooling environment.

The board game apparatus in accordance with the invention, includes a plurality of playing pieces, each representing a vehicle to be controlled by a respective player. A board substrate supports a playing surface having differentiated markings. The markings include symbolic representations of the topography of a hypothetical community including buildings and a multiplicity of intersecting roadways. The roadways include markings which divide each roadway into a multiplicity of distinct, serially connected road segment intervals along which the game pieces are moved. Each player begins the game with the same number of points, and the winner is the player who arrives at his or her destination with the fewest points lost along the way.

The markings further include a first class of indicia associated with some of the road segment intervals, defining a plurality of first traffic control parameters that influence the movement of the game pieces, each of the first parameters having a respective negative point value. The first parameters include stop signs and traffic lights, for example. A second class of indicia are marked on the playing surface and associated with some of the road segment intervals, for indicating the occurrence of an unusual event or traffic violation when occupied by a game piece. Upon landing on such second class of indicia, the player selects one of a multiplicity of event cards, each event card describing a particular one of a respective plurality of events, usually traffic violations. The player who takes an event card is then asked a question pertaining to automotive safety or traffic laws. If the player who selected the event card answers correctly, no points are lost. If the player answers incorrectly, points are lost in accordance with the particular event card selected.

A third class of indicia associated with some of the road segment intervals may be included to define a plurality of third traffic control parameters that have no point values, but specify one way streets, no-U turns, prohibited entry, no left turn, or the like. A fourth class of indicia associated with some of the road segment intervals can also be provided, for defining a plurality of fourth parameters indicative of problem or unusual driving conditions, having point values associated therewith. These can include police radar installations, road construction, a stopped school bus or the like.

In a preferred form of the game, all players begin in a home zone centered on the board, and each travels toward a different destination zone in one of the corners of the board. Chance means, such as dice, are used to determine the number of moves that a player can make in a given turn.

The inventive game board apparatus combines the elements of chance, strategy, and education in a manner not previously available in travel-type board games.

BRIEF DESCRIPTION OF THE DRAWINGS

FIG. 6 represents a police report which contains a list of events, questions, answers and point values;

FIG. 8 schematically represents a licensed report, one of which is preferably used by each player.

DESCRIPTION OF THE PREFERRED EMBODIMENT

FIGS. 1–8 taken collectively represent the preferred embodiment of the game board apparatus in accordance with the present invention.

Figure 1:
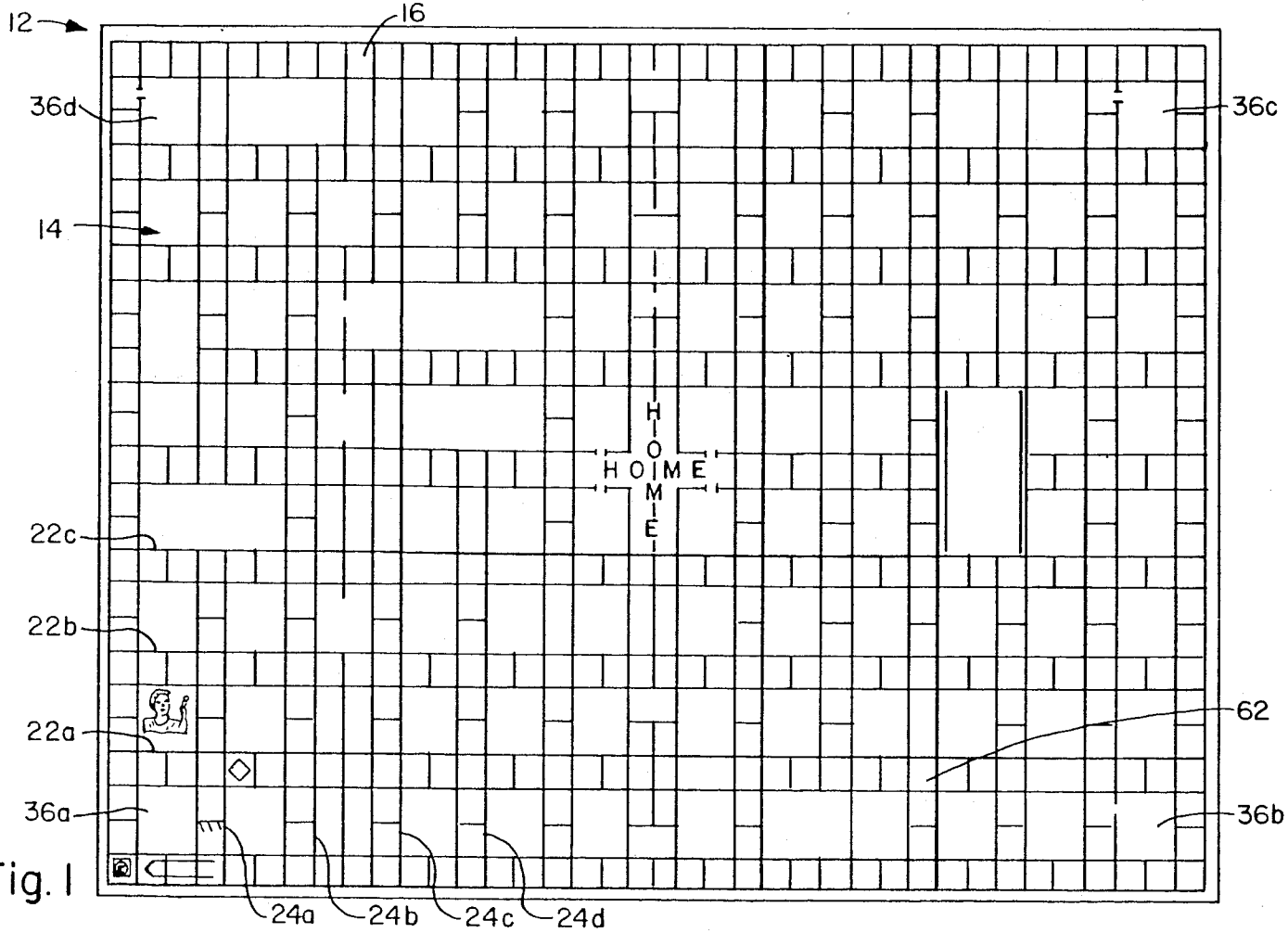
FIG. 1 is a schematic plan view of the board substrate and playing surface in accordance with the invention.
Figure 2:
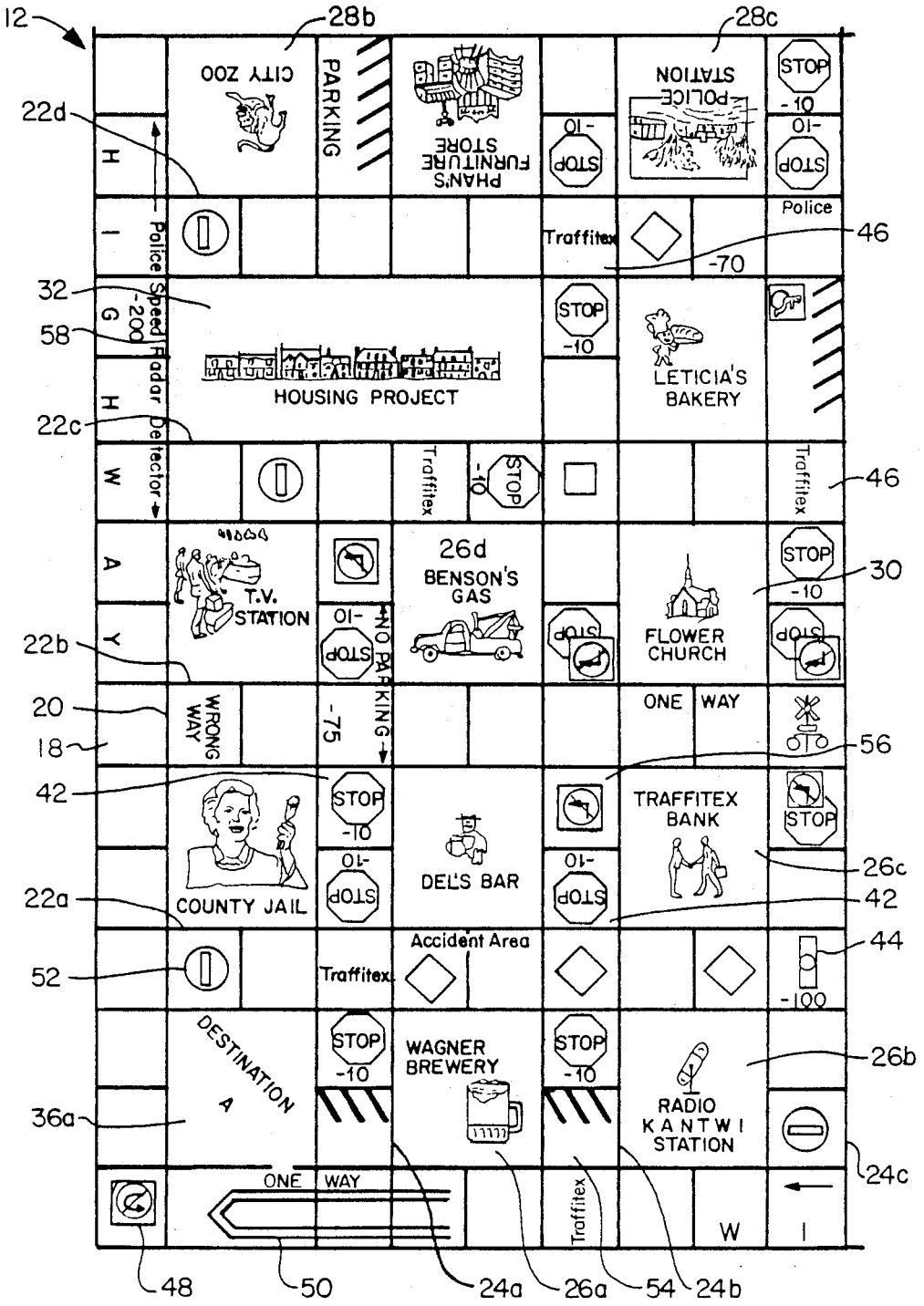
FIG. 2 is a detailed view of the lower left corner of the game board shown in FIG. 1.

FIGS. 1 and 2 show a square, or otherwise quadrangular board substrate 12, which may be folded on a center line (not shown) for supporting a playing surface 14 which may be drawn directly on the board or take the form of a printed sheet secured to the board substrate 12. Alternatively, the board substrate 12 could be the monitor or similar display surface substrate of a computer or other visual device with a playing surface 14 defined by images superimposed on the substrate 12.

The dominant feature of the playing surface 14 is a plurality of roadways, preferably including quadrangular roadway 16 along the playing surface outer boarder, and a plurality of interior roadways 22, 24. Each roadway is defined by longitudinal markings differentiated from the background of the substrate 12 or playing surface 14, and is further divided into a multiplicity of distinct, serially connected road segment intervals 18 along which the game pieces are to be moved. Typically, these markings would be lines 20 traverse to the longitudinal path of the roadway.

A plurality of east - west roadways 22a, 22b, 22c, . . . . , 22g preferably lie on a rectilinear grid, perpendicular to a plurality of north - south roadways 24a, 24b, 24c, . . . . , 24k. The roadways 22, 24 intersect at a plurality of locations on the playing surface 14, but it should be appreciated that each north, south or east, west roadway need not span the full distance between opposite portions of the boarder roadway 16.

Figure 3:
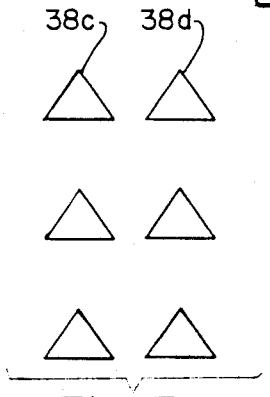
FIG. 3 schematically represents a plurality of game pieces.

The roadways 16, 22, and 24 are, in effect, superimposed on a layout comprising symbolic representations of the topography of a hypothetical community including building such as commercial establishments 26a, 26b, 26c, and government buildings 28a, 28b, 28c. Similarly, a church 30, a housing project 32, and other places on interest appear throughout the playing surface 14. In the center of the playing surface a home zone 34 is delineated, and, preferably four destination zones 36a, 36b, 36c, and 36d are located in respective corners of the playing surface. A plurality of game pieces 38a–h are shown in FIG. 3 and in the home zone 34.

At the beginning of the game, each player selects one game piece 38, which may be differentiated by color or shape and places it within the home zone 34.

The game may be played by three or more players, two of whom are contestants and one of whom serves as a policeman in a manner to be more fully described below. The object of the game is for each player who begins his journey in the home zone 34, to reach a selected destination 36, while minimizing delays due to traffic law and safety violations, traffic control signals, and problem conditions such as road construction and the like. Each player begins the game with, for example, 2,500 points and during the course of travel from the home zone 34 to a particular destination zone 36a, loses points along the way depending upon the frequency and type of encounters of various indicia associated with the roadway intervals, as will be described more fully below.

Figure 4:
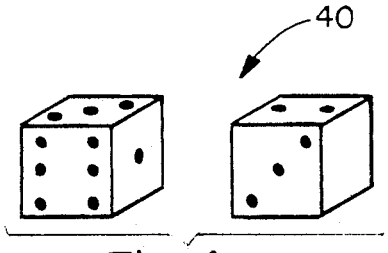
FIG. 4 schematically represents chance devices used with the game.

The number of moves to be taken by each player in a given turn is determined by that player's operating a chance device such as the dice 40 shown in FIG. 4. The player typically has many routes by which he or she can travel from a given road interval where the player's piece is located, to the ultimate or intermediate destination. Thus, a significant element of strategy is important in the game. The strategy revolves around the influence of at least two, and preferably four types of indicia marked on the playing surface and associated with respective roadway intervals.

The first class of indicia define a plurality of traffic control parameters that influence the movement of the game pieces, with each of the parameters having a respective subtractive point value associated therewith. These first indicia include stop signs 42, and traffic lights 44. Upon landing and occupying an interval marked with the parameter of the first class of indicia, the player must subtract the indicated number of points from his current score.

A second class of indicia is provided on a plurality of other road segment intervals to designate an unusual event personal to the player such as a traffic violation, when such interval is occupied by a game piece. Alternatively, the event can be deemed to have occurred whenever a player passes an interval marked with the second indicia. As used herein "traverse" means occupy or pass over a roadway interval. In the illustrated embodiment, the intervals of the second class of indicia are indicated by the word "Traffitex" 46. The consequence of landing on any one of such intervals is unpredictable as to the potential loss of points. In a manner to be more fully described below, a player who lands on an interval having a second parameter associated therewith, will be confronted by the policeman who will ask at least one question. The player must answer correctly or suffer the loss of a significant number of points. The questions and answers all relate to traffic laws and vehicular safety, and thus serve an important educational function for all participants in the game.

A third class of indicia are preferably included on the playing surface 14, for defining a plurality of third traffic control parameters having no point value associated therewith. These may include parameters for no U turn 48, one way street 50, prohibited entry 52, a parking lot with no through traffic 54, and no left turn 56.

A fourth class of indicia associated with some of the road segment intervals is also preferably included for defining a plurality of fourth parameters indicative of problem traffic conditions, each of the fourth parameters having a point value associated therewith. These can include police radar installations 58, and a stopped school bus 62.

Figure 5:
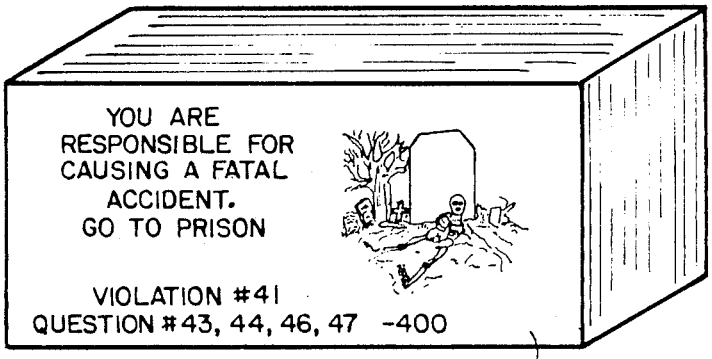
FIG. 5 represents a stack of event cards in accordance with the invention.

FIG. 5 schematically shows a stack of event cards 64, which are preferably placed on a designated location on the playing surface 14, but may alternatively be stacked in any convenient location between the players. When a player lands on a Traffitex interval 46, the player must select the next available event card 64. The event card preferably carries an "E" or similar indicia to distinguish it from the warning cards to be described below. Most event cards carry a number identifying a particular violation, as well as a description of the violation. Some event cards may state that an insurance premium is due, or that the player is awarded a safe driving bonus. These events may carry negative or positive point consequences as indicated on the event card. The policeman holds a police report 66 as shown in FIGS. 6. The police report preferably contains four columns of information. The first column 68 is a list of all violations appearing on the event cards, numbered correspondingly. Adjacent each violation on the list, is a second column 70 containing a question relating to vehicular safety or traffic laws. In the third column 72, a list of correct answers appears in correspondence with each of the questions. In the fourth column 74 a point value for the given violation is indicated. Preferably, the questions and answers are taken from authoritative sources such as the National Drivers Manual published by the United States Department of Transportation or manuals from the various states and similar safety agencies.

The policeman asks the player who has selected a given event violation card 64, the question 68 associated with that violation as printed on the police report 66. If the player answers correctly, the player loses only half the penalty points indicated in column 74 of the police report card 66. If the player answers the question incorrectly, the indicated number of points is subtracted from the player's current score. Partial points may be subtracted (typically one half) for nearly correct answers.

It should be appreciated that the particular list of violations, questions, answers, and point values appearing on violation cards 64 and the police report sheet 68, can take a variety of forms. For example, the answers need not be in multiple choice format, without departing from the spirit and scope of the invention. Moreover, in a more sophisticated embodiment of the invention, the policeman and the police report 66 could be programmed in a computer such that when the player indicates the occurrence of a particular violation 64, 68, the appropriate question 70 is displayed to the player, a choice of answers 72 provided, and a correct or incorrect response acknowledged with the point consequence 74 automatically added to the player's score.

Figure 7:
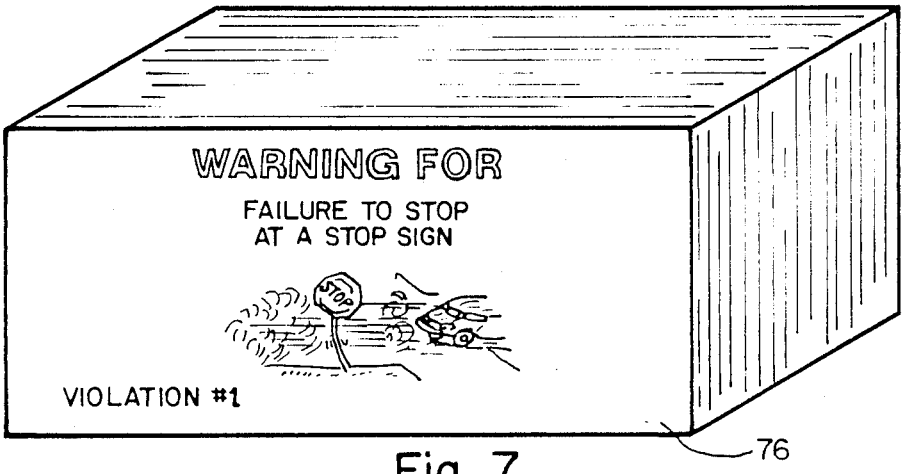
FIG. 7 schematically represents a multiplicity of warning cards respectively associated with violations appearing on the event cards of FIG. 5.

As shown schematically in FIG. 7, in a preferred embodiment of the invention, a stack of warning cards 76 is also provided, with some or all of the warning cards being distributed to the players at the beginning of the game. The warning cards are differentiated by color or other indicia from the event cards 64, but in other respects correspond to the event violation cards. For example, each warning card may have a "W" rather than an "E" in a corner thereof, but the number of the violation and the description may be identical. Each player holds his allotment of warning cards 76 during the course of the game, until the player lands on an event interval 46 and selects a violation card 64. If the player holds the warning card 76 that corresponds to the violation card 64, the player presents the warning card to the policeman and avoids the question and answer, and thus the potential point loss, associated with the violation card. The policeman keeps the warning cards that have been used to avoid the consequence of the violations, so that a warning card, once used, cannot be used again.

In a typical game board apparatus, the stack of event cards 64 may include each violation two or three times, whereas the stack of warning cards 74 would only include a particular violation once. Alternatively, the event cards 64 can be continuously reused during the course of a game whereas the warning cards 76 are permanently removed from the game once used.

FIG. 8 illustrates a license report 78 that is preferably held by each player in the game to keep track of each player's current score, as points are subtracted from the 2,500 initial points. Typically, whenever a player land on a roadway interval that has point consequences, i.e., having a first, second, or fourth parameter, the player hands his license report 78 to the policeman who subtracts the appropriate number of points. Alternatively, in a computer implemented version of the game board apparatus, the license report 78 can be stored and displayed by the computer.

It should be appreciated that various additional or modified rules for implementing the game as described hereinabove, may be used. For example, the boarder roadway 16 can be arranged as a one way "highway" containing no parameters, or possibly only a few parameters of the fourth type, such as police radar or road construction. If a player lands on and occupies the same interval as another player, this can be considered a collision and the player will have a certain number, for example 200 points, automatically deducted from his score. Special rules can be associated with the parking lots 54. For example, a player may avoid landing on an interval having a potentially adverse consequence, by turning into a parking lot. This may be permitted, for example, if the player can reach the parking lot on exact count, or optionally if the lot can be reached within one or two intervals of the exact number of intervals permitted to be moved in accordance with the thrown dice 40.

A functional equivalent to the physical marking associated with the second class of indicia, i.e., the Traffitex violation intervals 46, on the roadways 16, 22, and 24, is a rule whereby if a player's roll results in "doubles", (i.e., two sixes, two threes, etc.), the player is deemed to experience a personal event and is required to pick up an event card 64 in the same manner as described above, with the same consequences. Similarly, a player may be required to return to "Home" 34 or "Go to Jail" as a result of throwing a particular pattern within the dice 40 or as a consequence of a "Jail" mark on an event card 64 or in the "point" column 74 on the policeman's report sheet 66. A player may, for example, role doubles on the dice 40 in order to be released from jail.

In a preferred embodiment, the player arriving at his or her destination with the highest number of points, wins the game regardless of whether such player was the first to arrive at his or her designated destination. Typically, each player selects his or her destination at the beginning of the game, but in an alternative implementation, each player may select one or more destinations for another player.

I claim:

1. A board game apparatus of the type wherein each player moves a respective game piece along a playing surface, comprising:

a plurality of playing pieces, each representing a vehicle to be controlled by a respective player;

board means defining a playing surface substrate;

a playing surface supported by the board means, said playing surface having differentiated markings thereon including, symbolic representations of the topography of a hypothetical community including a multiplicity of intersecting roadways, means for dividing each roadway into a multiplicity of distinct, serially connected road segment intervals along which the game pieces are to be moved, a first class of indicia associated with some of the road segment intervals, for defining a plurality of first traffic control parameters that influence the movement of the game pieces, each of the first parameters having a respective point value associated therewith, and a second class of indicia associated with some of the road segment intervals, for indicating the occurrence of unusual events when traversed by a game piece;

chance means for specifying the number of road segment intervals that a player can move a game piece along a roadway during a given turn;

a plurality of event cards, one of which must be taken by a player upon traversing a roadway interval having said second class of indicia associated therewith, some of the event cards describing a particular one of a respective plurality of possible traffic violations;

a police report sheet containing, a list of all violations appearing on said event cards, a question corresponding to each violation on the list, each question pertaining to automotive safety or traffic laws, a correct answer to each of said questions, and a point value associated with each violation on the list.

2. The board game apparatus of claim 1, further including a third class of indicia associated with some of the road segment intervals, for defining a plurality of third traffic control parameters having no point values associated therewith.

3. The board game apparatus of claim 2, wherein said third class of indicia include means defining a parking zone that spans at least one road interval segment.

4. The board game apparatus of claim 3, wherein said third parameters include means for specifying that movement of a game piece is permitted in only one direction along the roadway containing the segment associated with a given of said third parameters.

5. The board game apparatus of claim 1, including means defining at least one terminus connected to at least one roadway, where the game pieces are positioned at the start of the game.

6. The board game apparatus of claim 3, wherein said means for defining a terminus includes a differentiated home zone in the center of the game board, from which all game pieces start the game.

7. The board game apparatus of claim 1, including means defining a plurality of differentiated destination zones spaced apart on the game board and connected to respective roadways.

8. The board game of claim 1, wherein said symbolic representations include pictorial and textual graphics representing at least commercial establishments and public works.

9. The board game apparatus of claim 1, wherein the roadways are arranged on a rectilinear grid.

10. The board game apparatus of claim 9, wherein one of said roadways forms a continuous, quadrangular outer border on the playing surface topography.

11. The board game apparatus of claim 10, wherein some but not all of the roadways span the playing surface between said boarder roadway.

12. The board game apparatus of claim 1, further including a fourth class of indicia associated with some of the road segment intervals for defining a plurality of fourth parameters indicative of problem travel conditions, each of the fourth parameter having a point value associated therewith.

13. The board game apparatus of claim 1, further comprising a plurality of warning cards each corresponding to one of the violations on said event cards, for cancelling the point value of the violation as appears on the police report.

* * * * *